United States Patent [19]

Oltman et al.

[11] Patent Number: 4,570,392

[45] Date of Patent: Feb. 18, 1986

[54] STOREHOUSE CONSTRUCTION

[75] Inventors: John P. Oltman, Cedar Falls; Steven J. Kreger, Waterloo; Richard D. Purchase, Cedar Falls, all of Iowa

[73] Assignee: Waterloo Industries, Inc., Waterloo, Iowa

[21] Appl. No.: 674,245

[22] Filed: Nov. 23, 1984

[51] Int. Cl.[4] ..... E04B 7/16

[52] U.S. Cl. ..... 52/64; 52/69; 52/79.5

[58] Field of Search ..... 52/64, 66, 69, 71, 79.5, 52/70, 94, 143, 79.1, 90

[56] References Cited

U.S. PATENT DOCUMENTS

| | | | |
|---|---|---|---|
| 2,712,677 | 7/1955 | Hyde | 52/69 |
| 2,762,084 | 9/1956 | Singer | 52/64 |
| 3,348,344 | 10/1967 | Tatevossian | 52/79.5 |
| 3,999,338 | 12/1976 | Behan et al. | 52/94 |
| 4,000,588 | 1/1977 | van der Lely | 52/71 |
| 4,070,804 | 1/1978 | van der Lely | 52/64 |
| 4,283,889 | 8/1981 | Dunn | 52/66 |
| 4,425,742 | 1/1984 | Markey et al. | 52/90 |
| 4,463,534 | 8/1982 | Crigler | 52/395 |
| 4,467,572 | 8/1984 | Somers et al. | 52/66 |

OTHER PUBLICATIONS

Photographs of various small sheds of typical construction.

1982 Outdoor Living Guide disclosing details on various types of storage sheds.

Arrow's advertising brochure for storage buildings.

Jer Manufacturing Inc. advertising brochure for construction of barn kits.

Handy Home Products advertising brochure for storage building kits.

Normstahl's advertising brochure for composter sheds.

Eastbrook's advertising brochure for aluminum storage buildings.

Sears catalog advertisement for construction of storage buildings.

Country General Store's advertising brochure for construction of frame connectors.

General disclosure for the construction of a garden--play barn.

*Primary Examiner*—J. Karl Bell

*Attorney, Agent, or Firm*—Allegretti, Newitt, Witcoff & McAndrews, Ltd.

[57] ABSTRACT

A knock down storage shed includes a back wall, front door panels and connected side walls forming an enclosure. Gambrel gable extensions on top of each of the side walls cooperate with a roof ridge cap and attached roof panels to define a roof. The lower pitch panels of the roof are hinged to the upper roof panels. An internal shelf is provided extending between the back wall and the side walls to the midline of the shed where it connects with a downwardly extending wall that depends from the roof ridge cap.

2 Claims, 5 Drawing Figures

Fig. 1
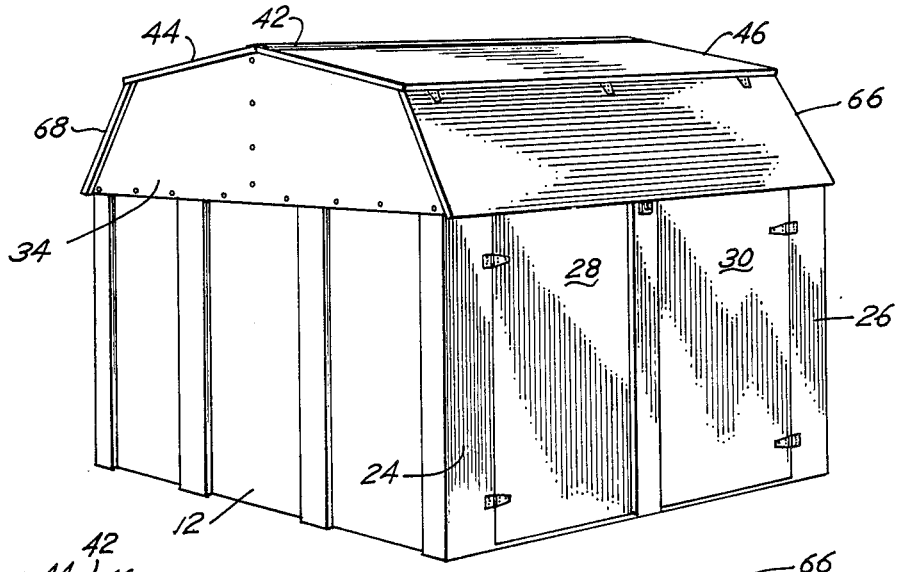
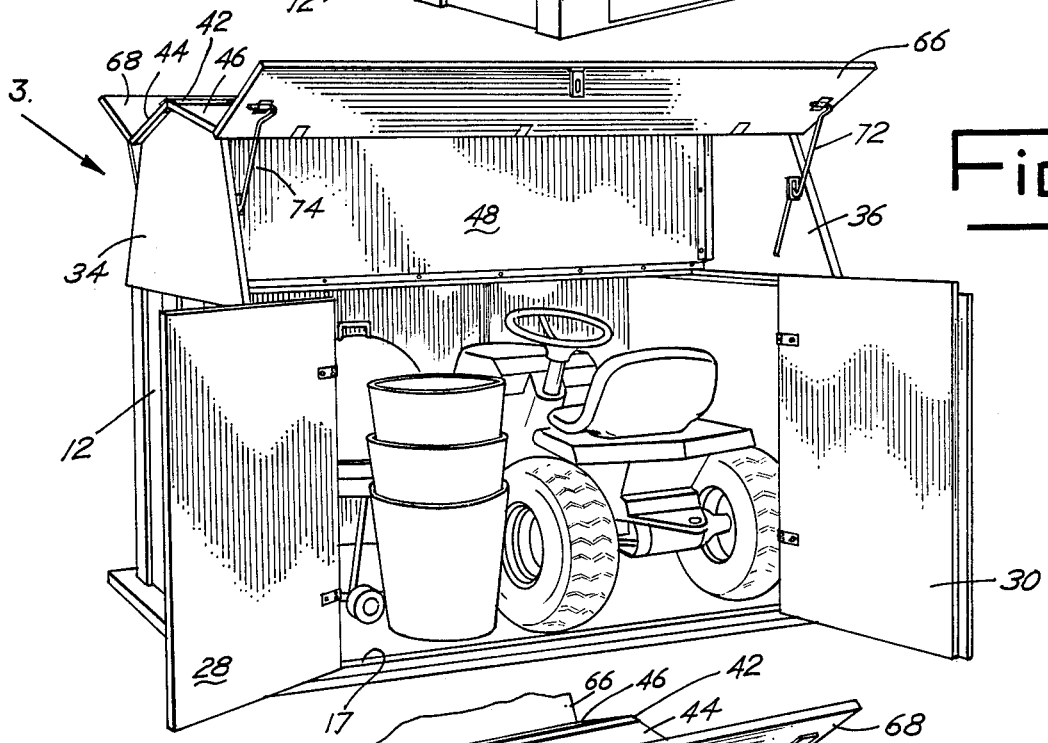
Fig. 2
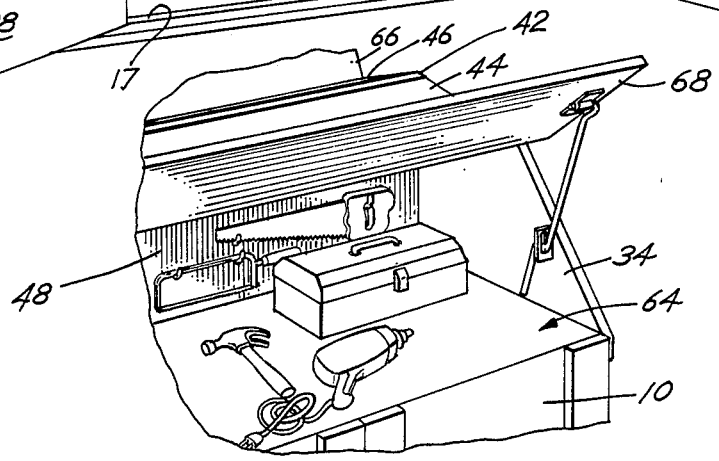
Fig. 3

STOREHOUSE CONSTRUCTION

BACKGROUND OF THE INVENTION

This invention relates to an improved knock down shed and more particularly to a knock down shed having a gambrel roof wherein roof panels associated with the lower pitch of the gambrel roof are attached by hinges to the upper pitch panels of the roof for ease of access to the interior of the shed.

Small sheds, especially knock down sheds which can be manufactured or made from a kit, are very popular and are often set up by homeowners, for example, for the storage of garden tools and other equipment. Currently there are many available knock down kits from which such sheds may be assembled. Typically such kits provide for the assembly of a four sided, rectangular shaped building having a roof and an access door along one side. The present invention relates to an improved assembly of component parts which may be utilized to make a completed shed from a knock down kit.

SUMMARY OF THE INVENTION

Briefly, the present invention comprises a knock down kit which is assembled from a package of planar members. The members may be assembled to define a pair of opposed side walls, a connecting back wall and front doors forming substantially a fourth wall of the shed. Gambrel gable extensions are provided for fastening to the top of each side wall to define a roof line having an upper pitch section and a lower pitch section. Roof panels are provided for cooperation with a roof ridge cap to define the upper pitch section of the roof. The lower pitch section comprises roof panels which are attached by hinges to the panels of the upper roof section. The back side of the shed includes a shelf which is positioned on top of the side walls and back wall and extends horizontally to the midline of the shed where it is joined by a vertically upstanding wall that attaches to the roof ridge cap. The back, lower pitch roof panel may be raised for access to the shelf within the shed. The front, lower pitch roof panel may also be raised and the front doors of the shed may be opened for access to the interior of the main storage chamber of the shed.

Thus, it is an object of the invention to provide an improved knock down, storage shed assembly kit.

It is a further object of the present invention to provide an improved knock down storage assembly shed which incorporates a gambrel gable roof line.

Still another object of the invention is to provide an improved storage shed assembly which incorporates the use of a unique roof ridge cap in combination with various roof panels and shelf panels.

Another object of the invention is to provide a knock down assembly kit for a storage shed which may be easily assembled in a manner which forms a sturdy and stable storage shed.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a perspective view of the improved knock down shed of the present invention as assembled;

FIG. 2 is a perspective view similar to FIG. 1 wherein the movable roof panels and front doors of the storage shed of the invention have been moved to the open position;

FIG. 3 is a partial perspective view of the back side of the storage shed of the invention in assembled condition wherein the rear roof panel has been raised to expose a storage shelf;

DESCRIPTION OF THE PREFERRED EMBODIMENT

Figure 4:
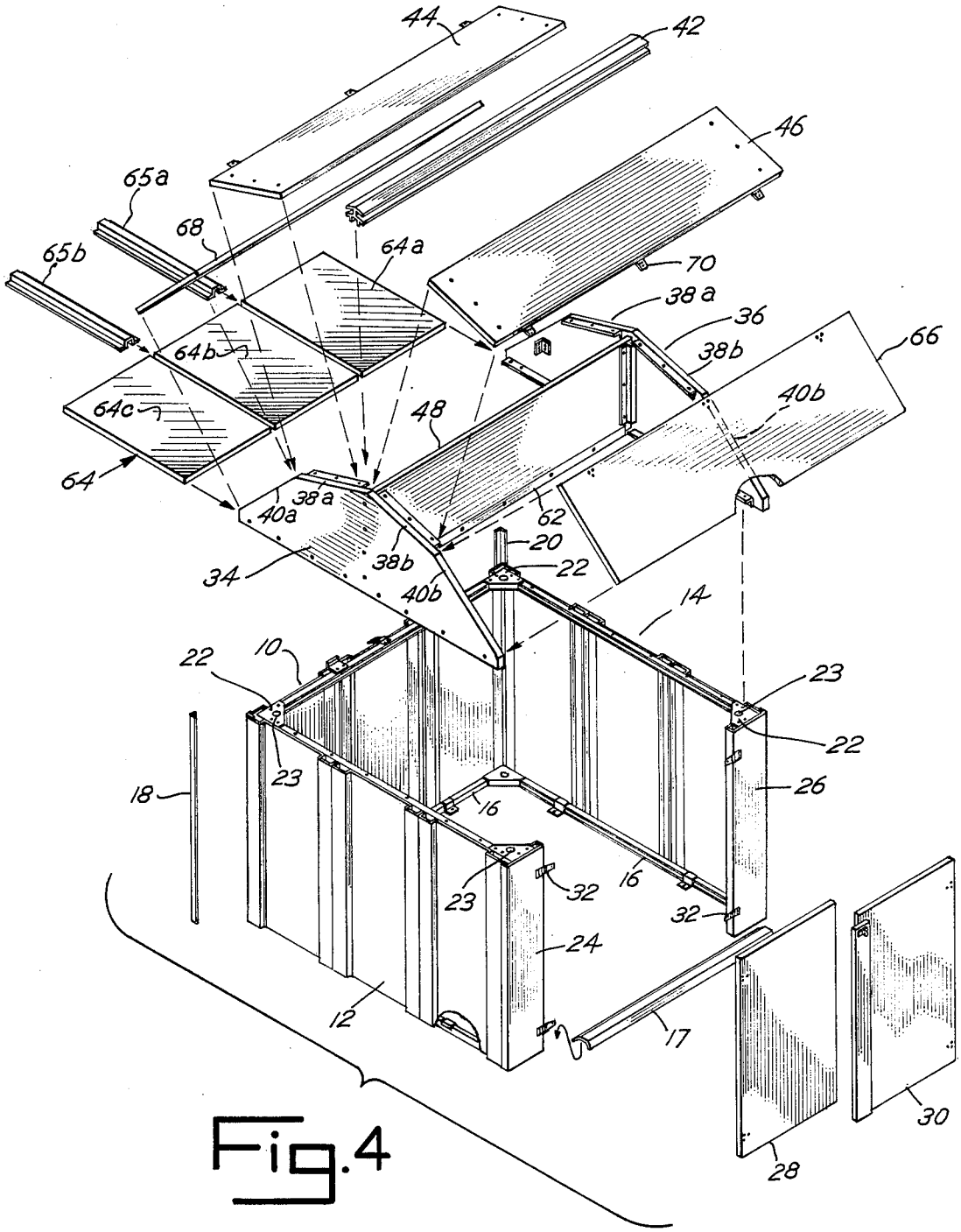
FIG. 4 is an exploded perspective view of the improved storage shed of the present invention.

The storage shed of the present invention is assembled from a knock down kit which includes a series of panels that may be formed of metal, wood, or a composite material. The panels are assembled using appropriate fasteners and subpanels, combined with brackets, bars, rods, angles and fasteners to provide the assembled storage shed. FIG. 1 illustrates the shed in assembled condition with the doors and various panels closed to prohibit access to the interior. FIG. 4 illustrates, in an exploded perspective view, the component parts and the way in which they are assembled to provide the knock down shed of the present invention.

Referring primarily therefore to FIG. 4 and additionally to the other figures, the shed includes a rear wall 10, and opposed side walls 12 and 14 connected to the rear wall 10. The walls 10, 12 and 14 may be fabricated from subpanels and are attached to a rectangular, rigid fixture 16 that defines the plan outline of the shed. The fixture 16 is comprised of four connected members forming a frame which may be fastened to a floor, for example, to support the shed in a fixed position on the floor. A threshold 17 is positioned at the bottom of the front entrance. The wall panels 10, 12 and 14 are joined at their corners by appropriate trim members 18 and 20 as well as appropriate braces 22. Braces 22 have a center opening 23 for cooperation with gable extensions 34 or 36 to align the extensions 34, 36.

The front side of the storage shed includes foreshortened panels 24 and 26 positioned on opposite sides of an opening. Panels 24, 26 are connected with walls 12 and 14, respectively, to define a door jamb. Front door panels 28 and 30 are attached by hinges 32 to the panels 24, 26, respectively. In this manner an enclosed chamber defining a major portion of the storage shed is defined.

Attached along the longitudinal top edge of each side panel 12 and 14 is a gambrel, gable extension 34 and 36, respectively. Each gable extension 34 and 36 includes an upper roof pitch surface **38*a* and 38*b* as well as a lower roof pitch surface 40*a* and 40*b* which define the gables of the roof for the shed. A special roof rigid cap 42 extends between and over the extensions 34 and 36 along the peak of the roof. The ridge cap 42 cooperates with upper roof panels 44 and 46 as well as a depending vertical interior wall 48 extending along the center line axis of the storage shed. Appropriate angles or brackets are attached between the extensions 34 and panels 44 and 46 as well as the vertical panel or wall 48** and are attached to the panels by appropriate fasteners in order to hold the assembled shed together.

Figure 5:
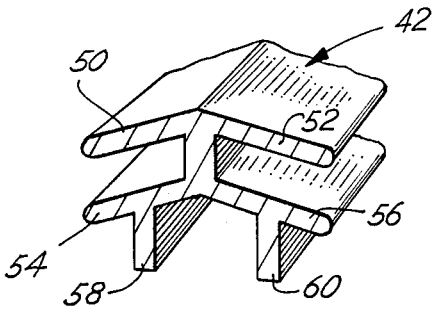
FIG. 5 is a cross sectional, perspective view of the special roof ridge cap associated with the storage shed of the present invention.

Importantly, as shown in FIG. 5, the roof ridge cap 42 includes upper laterally extending flanges 50 and 52 which fit over the roof panels 44 and 46, respectively, and lower outwardly extending flanges 54 and 56 which define a slot for receipt of the panels 44 and 46, respectively. Vertically downward depending flanges 58 and 60 cooperate with the wall 48 to define a slot for receipt of that wall 48 to hold the wall 48 in fixed position and add further rigidity to the assembled shed construction. The arrangement of the flanges 50 and 52 facilitates maintenance of water tight construction of the shed.

The wall section or panel 48 rests on an L-shaped angle iron 62 which connects between the walls 12 and 14 and supports the panel 48 so that it will fit within the slot defined by the downwardly depending flanges 58 and 60.

A shelf 64 of multisectioned panels 64*a*, 64*b*, 64*c* extends from the back wall 10 to the angle 62 and thus to the wall 48. The shelf 64 also extends between the side walls 12 and 14. Thus, as depicted in FIG. 3, a shelf space is provided between the back wall 10, the side walls 12 and 14, and the vertical upstanding panel 48. The panels 64*a*, 64*b*, 64*c* forming shell 64 are retained together and made rigid by brackets 65*a* and 65*b*.

Lower roof panels 66 and 68, respectively, are attached by hinges 70 to the upper roof panels 46 and 44, respectively. The lower roof panels 66, 68 associated with the lower pitch section of the gambrel gable extensions 34 and 36 may be pivoted about the hinge axis of hinges 70 in order to raise those panels 66 and 68 as depicted in FIGS. 2 and 3. Associated with each side of the panels 66 and 68 and connecting between the inside of those panels 66 and 68 and the inside of the extensions 34 and 36 are bracket support members 72 and 74 in FIG. 2 which may be positioned, for example, to hold the panel 66 open. Of course the brackets 72 and 74 may be released in order to close the panels 66 and 68 to the position shown in FIG. 1.

As depicted in FIG. 2, opening of the front doors 28 and 30 of the shed permits access to the main interior of the shed. Raising the front, lower roof panel 66 provides more room for access of tall objects in the shed and insertion from the front of the shed. Raising the back roof panel 68, such as shown in FIG. 3, permits access to a special storage shelf 64 in the shed which is separate from the main chamber of the shed. With this arrangement, access at workbench level is provided with respect to work tools, for example, as depicted in FIG. 3 on shelf 64. Larger objects may be stored in the main chamber of the storage shed as depicted in FIG. 2.

Various modifications of the construction and components are possible. Thus, while a preferred embodiment of the invention has been set forth, it is to be understood that the invention is limited only by the following claims and their equivalents.

What is claimed is:

1. An improved knock down shed construction comprising, in combination:

opposite the side walls and a back wall for forming a three sided enclosure, said side walls and back wall being substantially rectangular in shape, said opposite side walls being substantially identical in shape;

a pair of vertically hinged doors forming a portion of the front wall, each of said vertically hinged doors being attached respectively to one of the side walls;

gambrel gable extensions from the top of each side wall, said gable extensions having a double pitch;

a roof ridge cap;

four roof panels, two of which are upper roof panels and are permanently attachable to the gable extensions, said upper roof panels extending in a direction between the side walls at the peak of the shed and further cooperative with the rood ridge cap, the other two remaining roof panels being lower roof panels, each lower roof panel being attachable to one of the upper roof panels, respectively, by hinge means to open outward and upward;

a vertical center line wall panel;

said roof ridge cap comprising an integrally formed longitudinal member having a length greater than the side wall spacing, oppositely disposed inclined slots at an angle equal to the upper gable of the roof, one of said slots adapted to receive one upper roof panel, said cap also including a depending center slot for receipt of the vertical wall panel depending from the roof ridge cap;

a horizontal shelf panel attachable between the top of the side walls and extending from the back wall to the vertical wall panel depending from the roof ridge cap; and means for fastening the panels, doors and ridge cap together to form the shed, whereby upon assembly of the shed, the front doors and the front, lower roof panel may be opened to permit entry to a main chamber of the shed, and the rear lower roof panel may be opened to permit entry to a horizontal storage shelf at the back side of the shed.

2. The shed of claim 1 including pivoting support arms connected between the lower roof panels and the gable extensions for supporting the lower roof panels in a desired position.

* * * * *